US008016703B1

(12) United States Patent
Kronengold et al.

(10) Patent No.: US 8,016,703 B1
(45) Date of Patent: Sep. 13, 2011

(54) ARROW SHAFT INSERT

(75) Inventors: David H. Kronengold, Tucson, AZ (US); Allen C. Rasor, Jr., Marana, AZ (US); Kevin Hansen, Tucson, AZ (US); Salvador D. Duran, Tuscon, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 249 days.

(21) Appl. No.: 12/547,234

(22) Filed: Aug. 25, 2009

(51) Int. Cl.
*F42B 6/04* (2006.01)

(52) U.S. Cl. ..... 473/582

(58) Field of Classification Search ..... 473/578, 473/582, 583, 584, 585, 586
See application file for complete search history.

(56) References Cited

U.S. PATENT DOCUMENTS

| | | | | |
|---|---|---|---|---|
| 4,006,901 | A | 2/1977 | Simo | |
| 4,381,866 | A | 5/1983 | Simo | |
| 4,387,697 | A | 6/1983 | Duke | |
| 4,534,568 | A * | 8/1985 | Tone | 473/583 |
| 4,671,517 | A * | 6/1987 | Winters | 473/583 |
| 4,920,625 | A | 5/1990 | Smith | |
| 4,943,067 | A * | 7/1990 | Saunders | 473/578 |
| 5,094,463 | A * | 3/1992 | Dryden | 473/570 |
| 5,114,156 | A | 5/1992 | Saunders | |
| 5,562,291 | A | 10/1996 | Garcia | |
| 6,027,421 | A | 2/2000 | Adams, Jr. | |
| 6,623,385 | B1 | 9/2003 | Cole et al. | |
| 6,887,172 | B2 * | 5/2005 | Arasmith | 473/583 |
| 6,932,728 | B2 * | 8/2005 | Palomaki et al. | 473/578 |
| 7,115,055 | B2 | 10/2006 | Palomaki et al. | |
| 7,207,908 | B1 * | 4/2007 | Gizowski | 473/583 |
| 7,651,421 | B2 * | 1/2010 | Smith et al. | 473/582 |

* cited by examiner

*Primary Examiner* — John Ricci
(74) *Attorney, Agent, or Firm* — Cahill Glazer PLC

(57) ABSTRACT

An archery projectile insert is provided with a rigid hollow tube having a collar at one end and an internally threaded bushing at an opposite end wherein the collar and bushing are cemented within the rigid tube; and wherein the three piece insert, formed into a unitary structure, is inserted into the hollow end of an archery shaft and cemented in place. A projectile tip having a shank and a threaded extension threadedly engages the internally threaded bushing to secure the tip in place to the projectile shaft.

7 Claims, 1 Drawing Sheet

ARROW SHAFT INSERT

FIELD OF THE INVENTION

The present invention relates to inserts for placement within a projectile shaft such as an archery arrow or crossbow bolt and more particularly to an insert for accepting an arrow tip to secure the tip in place during shooting of the arrow. The invention also relates to a method for making an archery projectile utilizing an insert.

BACKGROUND OF THE INVENTION

Modern compound archery bows and crossbows provide significantly increased power and require archery projectiles to withstand the forces imparted thereto through acceleration of the projectile by the corresponding bowstring. The projectiles incorporate shafts having a point that can be selected for archery practice, field points or broad heads for hunting. It is evident that securely attaching the projectile tip to the shaft is critical and the security with which the attachment is made is paramount to the utilization of the projectile for its intended purpose. The acceleration imparted to arrow shafts by modern compound bows and crossbows results in frequent loosening or dislodgement of the corresponding projectile tip when the manner in which these tips are secured to the shafts are not appropriately secure. Consideration must also be given to any attachment technique that increases the weight of the arrow shaft; the weight of any system for attaching a projectile tip to the archery projectile must be kept to a minimum. Inserts have been developed to be inserted into the open end of a hollow arrow shaft to provide a means for securing a projectile tip to the arrow shaft. The conventional aluminum arrow inserts, when adhesively secured to the internal diameter of the hollow arrow shaft frequently fail to securely hold the point securely.

OBJECTS OF THE INVENTION

It is therefore an object of the present invention to provide an archery shaft insert for accepting an archery projectile point to securely fasten the point to the arrow shaft.

It is another object of the present invention to provide an insert for placement within a hollow arrow shaft that will securely fasten to the shaft and permit the threaded engagement of an archery projectile tip thereto.

It is another object of the present invention to provide an improved archery projectile incorporating a subassembly for receiving and securing a projectile point to the shaft of an arrow or bolt.

It is still another object of the present invention to provide a method for modifying a hollow arrow shaft to securely accept a chosen archery tip.

These and other object of the present invention will become apparent to those skilled in the art as the description thereof proceeds

SUMMARY OF THE INVENTION

The invention incorporates an archery projectile and method for making the projectile having the insert formed into a subassembly constructed of a rigid tube having a collar and flange secured at one end thereof and an internally threaded cylindrical bushing secured at an opposite end thereof. The tube is dimensioned to be slidably positioned in the open hollow end of a tubular arrow or bolt. The collar and cylindrical bushing are adhesively secured to the opposite end of the rigid tube to form a subassembly that is inserted and adhesively secured to the open end of the arrow or bolt. The collar includes a radially extending flange that has an external diameter equal to the diameter of the arrow shaft. The collar with the flange thus provides a means to protect the open end of the arrow shaft while providing a seating surface for an arrow tip or point to be secured to the arrow shaft. The internally threaded cylindrical bushing accepts the threaded stem extending from the arrow tip to permit the tip to be threadedly engaged to the subassembly.

The method of the present invention includes selecting an appropriate rigid tube having the desirable characteristics to support a flanged collar at one end thereof and an internally threaded cylindrical bushing at the other end thereof. The collar and bushing are inserted into opposite ends of the rigid tube and cemented in place to form a subassembly. This subassembly is then adhesively secured in the open end of a hollow arrow shaft with the collar flange firmly abutting the open end of the arrow shaft.

BRIEF DESCRIPTION OF THE DRAWINGS

The present invention may more readily be described by reference to the accompanying drawings in which.

DETAILED DESCRIPTION OF THE INVENTION

Figure 1:
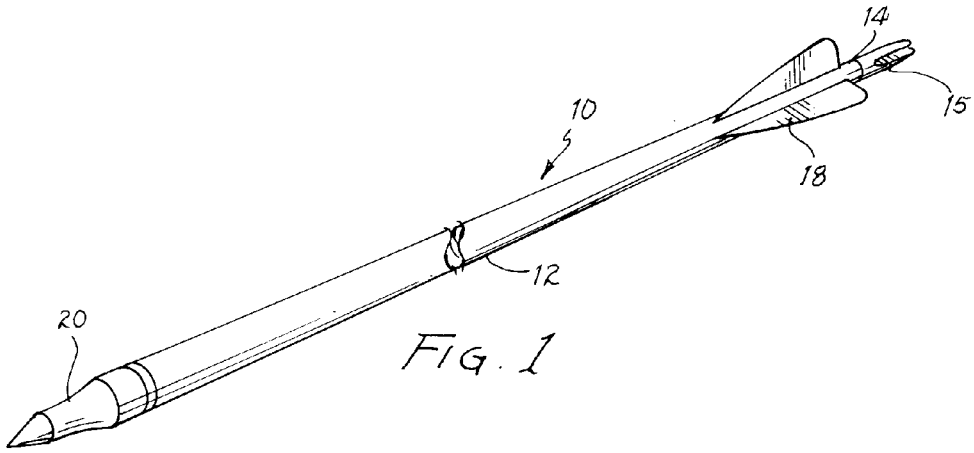
FIG. 1 is a perspective view of an archery projectile incorporating the teachings of the present invention.

As used herein, the term "archery projectile" is meant to include archery arrows and bolts. For purposes of the present invention the terms are interchangeable. Referring now to FIG. 1, an archery projectile 10 is shown incorporating the teachings of the present invention. The projectile chosen for illustration is an archery bolt typically used with crossbows. The projectile 10 includes a longitudinally extending hollow cylindrical shaft 12 terminating at one end 14 with a nock 15 for engagement with a bowstring. Fletching 18 is provided for stabilization of the projectile in flight. The forward end of the shaft terminates in a projectile tip 20; the tip shown is a field tip but may include practice tips or hunting tips such as broad heads. The tips are attached to the shaft 12 and secured by threadedly engaging its shank (to be described) extending from the projectile tip into the hollow end of the shaft.

Figure 2:
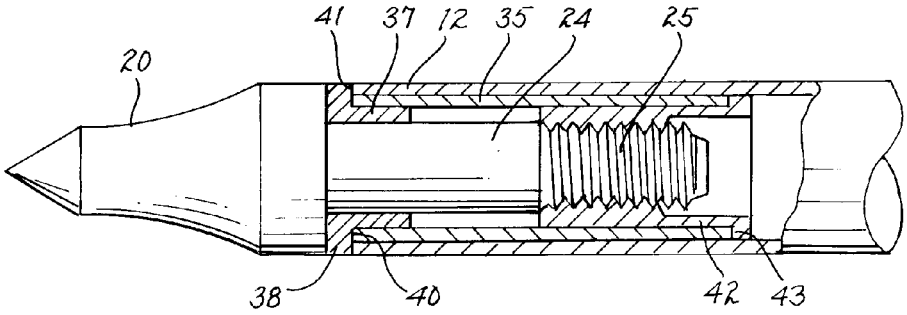
FIG. 2 is an enlarged portion of FIG. 1, partly in section, illustrating the positioning of the subassembly of the present invention in a hollow arrow shaft.
Figure 3:
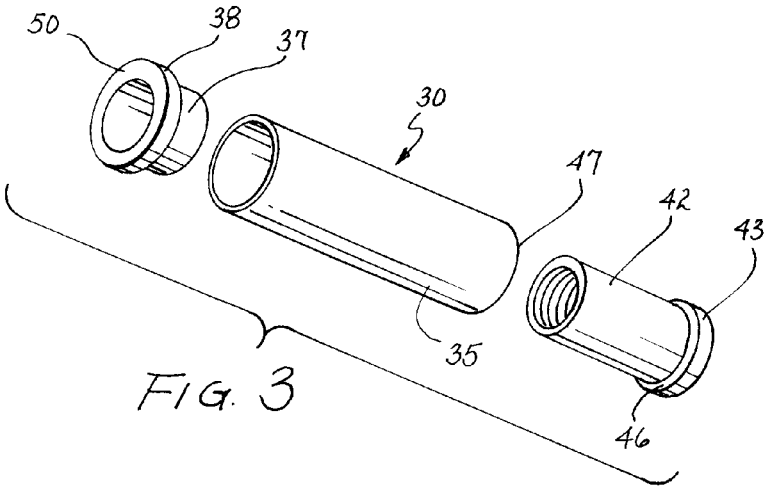
FIG. 3 is an exploded perspective view showing the collar, rigid tube, and internally threaded cylindrical bushing that are utilized in the present invention.

Referring to FIG. 2, it may be seen that the projectile tip 20 incorporates a projectile tip shank 24 that terminates in a threaded extension 25. The arrow shaft terminates at its end to present a hollow cylindrical receptacle for receiving an insertable subassembly 30 (FIG. 3). The subassembly includes a hollow cylindrical rigid tube 35 having an outside diameter slightly less than the inside diameter of the hollow projectile shaft.

The rigid tube may be constructed of carbon fiber or similar rigid material; a characteristic that is desirable in the tube is that it be securely cementable to the interior of the hollow arrow or bolt shaft. A collar 37 having a radially extending flange 38 is positioned in one end of the tube and cemented in place. The collar flange 38 has an outside diameter substantially equal to the outside diameter of the shaft 12 and provides an abutting flange surface 40 for contacting the exposed edge 41 of the open hollow arrow shaft 12. The inside diameter of the collar is chosen to slidably engage the projectile tip shank 24 and firmly support the shank when it is inserted into the collar 37. The opposite end of the tube 35 receives an internally threaded bushing 42. The bushing includes a bushing flange 43 having an outside diameter equal to or less than the outside diameter of the rigid tube 35 (but greater than the inside diameter of the tube 35) and provides an abutting flange surface 46 to abut the end 47 of the tube 35. The outside diameter of the bushing is less than the inside diameter of the rigid tube 35 and is selected to slidably engage the internal surface of the rigid tube. The bushing is inserted into the tube and is cemented in place to form a three element subassembly.

The subassembly thus forms an insert incorporating a rigid tube having a collar cemented in place at one end and an internally threaded bushing cemented in place at the other end. This three piece subassembly, forming a unitary structure after its elements have been cemented in place, is then inserted into the open end of the arrow/bolt shaft. The collar flange surface 50 contacts the projectile tip as the latter is screwed into the end of the arrow.

The method of the present invention includes the selection of a rigid tube 35 having an outside diameter suitable for insertion in the open end of a hollow projectile shaft 12. A collar 37 having a flange 38 is slidably positioned within one end of the tube 35 and cemented in place; the collar incorporates a collar flange 38 having an outside diameter substantially the same as the outside diameter of the hollow shaft 12. An internally threaded bushing 42 is inserted in the opposite end of the rigid tube 35 and is cemented in place to form a subassembly. The bushing 42 includes a flange 43 having an outside diameter preferably the same as the outside diameter of the rigid tube 35. The tube 35 with the collar 37 and internally threaded bushing 42 are then provided with an application of a cement compound and inserted in the open end of a projectile shaft and positioned so that the collar flange 38 abuts exposed edge 41 of the open end of the hollow projectile shaft. When the subassembly is positioned and appropriately cemented in place, a projectile tip is inserted in the subassembly with the projectile tip shank slidably passing through the internal diameter of the collar with the threaded extension of the tip shank engaging and threadedly being secured to the internally threaded bushing. It may be seen that tightening the projectile tip on the arrow shaft will not injure or damage the end of the shaft that might otherwise occur if the collar were not present. The tensile forces that are applied by threadedly engaging the projectile tip are transmitted to the internally threaded bushing which in turn transmits the resulting compressive forces to the rigid tube. Thus, the compressive forces resulting from tightening the projectile tip are distributed to the rigid tube in addition to that portion of the shaft that is cemented to the rigid tube.

The rigid tube may advantageously be constructed of carbon fiber. It has been found that the adhesion of the carbon tube provides an improved bond with the arrow shaft. Suitable adhesives may be used but it has been found that cyanoacrylate provides excellent adhesion to withstand any shock loading that may occur during firing of the arrow. When the projectile tip, which usually is constructed of steel, is screwed through the collar and into the internally threaded bushing of the three piece insert or subassembly, the projectile tip is held securely to the arrow and provides structural integrity as well as proper alignment of the projectile tip with the longitudinal axis of the shaft.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed:

1. A subassembly for insertion in an open end of a hollow cylindrical archery projectile shaft for receiving and securing a projectile tip to the shaft, said shaft having an outside diameter and an inside diameter, comprising:

(a) a rigid cylindrical tube having an outside diameter less than the inside diameter of said shaft and having an inside diameter;

(b) a hollow cylindrical collar having an outside diameter less than the inside diameter of said rigid tube, said collar having a radially extending collar flange at an end thereof, said collar flange having an outside diameter the same as the outside diameter of said shaft;

(c) an internally threaded bushing having an outside diameter less than the inside diameter of the rigid tube and having a radially extending bushing flange at an end thereof, said bushing flange having an outside diameter greater than the inside diameter of said tube and less than the inside diameter of said shaft; and (d) said collar and bushing inserted and secured in opposite ends of said tube.

2. The subassembly of claim 1 wherein said collar and bushing are secured to said tube by cement.

3. The subassembly of claim 2 wherein said cement is cyanoacrylate.

4. In an archery projectile having a hollow cylindrical shaft with an inside and outside diameter, and having a nock and fletching at one end thereof and an open end at an opposite end thereof, the improvement comprising:

(a) a rigid cylindrical tube having an outside diameter less than the inside diameter of said shaft and having an inside diameter;

(b) a hollow cylindrical collar having an outside diameter less than the inside diameter of said rigid tube, said collar having a radially extending collar flange at an end thereof, said collar flange having an outside diameter the same as the outside diameter of said shaft;

(c) an internally threaded bushing having an outside diameter less than the inside diameter of the rigid tube and having a radially extending bushing flange at an end thereof, said bushing flange having an outside diameter greater than the inside diameter of said tube and less than the inside diameter of said shaft;

(d) said collar and bushing inserted and secured in opposite ends of said tube to form a subassembly;

(e) said subassembly inserted and secured in the open end of said shaft; and (f) a projectile tip having a shank and a threaded extension extending into said open end threadedly engaging said internally threaded bushing to thereby secure the tip to the shaft.

5. The archery projectile of claim 4 wherein said collar and bushing are secured to said tube by cement and said subassembly is secured in said open end by cement.

6. The archery projectile of claim 5 wherein said cement is cyanoacrylate.

7. A method for making an archery projectile having a hollow cylindrical shaft with a nock positioned at a first end and having an inside diameter and an outside diameter defining an open end having an exposed edge comprising:

(a) providing a rigid cylindrical tube having an outside diameter less than the inside diameter of said shaft and having an inside diameter;

(b) providing a hollow cylindrical collar having an outside diameter less than the inside diameter of said rigid tube, said collar having a radially extending collar flange at an end thereof, said collar flange having an outside diameter the same as the outside diameter of said projectile shaft;

(c) providing an internally threaded bushing having an outside diameter less than the inside diameter of the rigid tube and having a radially extending bushing flange at an end thereof, said bushing flange having an outside diameter greater than the inside diameter of said tube and less than the inside diameter of said shaft;

(d) inserting and cementing the collar in one end of the tube and inserting and cementing the bushing in an opposite end of the tube to form a unitary subassembly; and (e) inserting and cementing the subassembly into the open end of said shaft with the radial collar flange abutting the exposed edge of said arrow shaft.

* * * * *